US005637384A

United States Patent [19]

Boot

[11] Patent Number: 5,637,384

[45] Date of Patent: Jun. 10, 1997

[54] PLASTERBOARD SUPPORT AND CAVITY SPACER

[75] Inventor: Phillip H. Boot, Pymble, Australia

[73] Assignee: Hanford Pty Limited, Norh Turramurra, Australia

[21] Appl. No.: 439,261

[22] Filed: May 11, 1995

Related U.S. Application Data

[63] Continuation-in-part of Ser. No. 229,020, Apr. 18, 1994, abandoned.

[30] Foreign Application Priority Data

Apr. 21, 1993 [AU] Australia ..... PL8395

[51] Int. Cl.[6] ..... B32B 7/02

[52] U.S. Cl. ..... 428/218; 428/52; 428/161; 428/164; 428/212; 428/223; 428/304.4; 428/318.4; 428/319.3; 428/411.1; 156/60

[58] Field of Search ..... 428/304.4, 317.1, 428/318.4, 319.3, 411.1, 218, 52, 212, 223, 161, 164; 156/60, 326; 52/264, 90.1

[56] References Cited

PUBLICATIONS

Ishji et al., Patent Abstracts of Japan, Jun. 1993, Grp.C1077, vol. 17, No.345, 05–44013.

Goto, Patent Abstracts of Japan, Mar. 1987, Grp.M567, vol. 11, No.71, 61–228936.

*Primary Examiner*—William Krynski

*Attorney, Agent, or Firm*—Michael J. Striker

[57] ABSTRACT

A composite laminated lath for fixing plasterboard consists of a length of lightweight rigid or semi-rigid resilient material overlaid by a layer of denser material penetrable by screws or nails and secured to said resilient material.

5 Claims, 5 Drawing Sheets

PLASTERBOARD SUPPORT AND CAVITY SPACER

CROSS-REFERENCE TO RELATED APPLICATION

This application is a continuation-in-part of application Ser. No. 08/229,020 filed Apr. 18, 1994, now abandoned.

BACKGROUND OF THE INVENTION

The present invention relates to a structural support for plasterboard or similar internal lining material used to supply a finish to the interior surface of concrete or masonry walling. Plasterboard and other lining materials are normally between 4 mm–16 mm thick and are manufactured in a variety of sheet sizes. The term "plaster board" as used in this specification is to be taken to include any type of sheet lining material for buildings.

Plasterboard sheets when used for wall lining are designed to be fixed to a structural framework constructed of timer or metal. The plasterboard fixing to the framework is accomplished by mechanical means such as nails for timber frames and "self tapping" screws for metal frames or a combination of either nails or screws and a suitable type of adhesive. In most cases the mechanical fixing means is used to hold the plasterboard sheeting in position temporarily until the adhesive sets.

Of the two mechanical fixing methods the nailing technique is by far the most popular and cheapest method as it requires no special screws or screw guns and therefore is easier and faster.

In some applications plasterboard sheets are fixed onto a masonry wall to give it a satisfactory surface finish instead of the usual surface application of portland cement mortar render. There are two common methods used to fix the plasterboard sheet to masonry walls, the sheets being glued or bonded directly to the masonry wall or fixed to a light or sub framework such as timer or metal lathes. These lathes are usually mechanically fixed onto the masonry wall prior to the plasterboard sheet fixing operation which is both difficult and expensive, requiring special masonry fixings and equipment.

Because lath sections are much smaller than normal walling studs they are usually made from metal, as timber, in these small sections, is unstable at lengths longer than one meter. Being metal makes it unpopular with plasterboard fixers as the plasterboard sheeting has to be screwed to the sub framing instead of the simpler nailing method. Similarly when the plasterboard is bonded directly onto the masonry wall temporary props have to be deployed to support the plasterboard sheets until the bonding glue sets.

In many cases a plasterboard lining is required on the inside of an external masonry wall which is subjected to moisture penetration on its external surface from weather elements. As plasterboard is easily damaged by water it is necessary in this case to create a cavity or air space between the masonry wall and the plasterboard sheeting.

SUMMARY OF THE INVENTION

The present invention consists in a composite laminated lath for fixing plasterboard, the lath consisting of lightweight rigid or semi-rigid resilient material overlaid by a layer of denser material penetrable by screws or nails and seared to said resilient material.

In keeping with these objects and with others which will become apparent hereinafter, one feature of the present invention resides, briefly stated, in a composite laminated lath for fixing plasterboard sheets which has a first elongated element consisting of a lightweight resilient material selected from the group consisting of a rigid material and a semi-rigid material, and a second elongated element overlaying said first elongated element and composed of a denser material penetrable by at least one fixing element selected from the group consisting of screws and nails, said first and second elongated elements having interlocking shapes so that in an assembled condition these elements are held together because of said interlocking shapes.

The term "interlocking" is used here to identify the shapes such that when two elements have interlocking shapes their shapes are usually complementary and the elements having such shapes engage in one another.

The invention described herein provides a new type of composite laminated lath that is simple to fix to masonry walling, can receive nails or screws and is inexpensive. It consists of a lightweight, rigid resilient material in a lath form that is very light, relatively soft, will bond easily, requiring no temporary support and because it is relatively pliable will generally conform to the deformations and contours of the masonry wall, for example, expanded polystyrene or polyurethane.

Attached to one side of the softer resilient material is a layer of more dense material, for example metal; this can be bonded by adhesive or attached by shape. The two layered laminated lath is bonded or mechanically fixed to the masonry wall with the interface of the masonry wall and the softer resilient material being the surfaces bonded together.

When used together in this way the lamination provides a lath that is easily bonded to the irregular surfaced masonry wall having a dense harder surface on the other side to which suitable lining material sheeting can be easily nailed.

The softer resilient material absorbs and transfers to the masonry wall the shock of the hammer force as the nail is being driven home. The denser harder layer that is being nailed to holds or anchors the nail in that position which in turn holders the plasterboard sheet and allows the adhesive to set, bonding the plasterboard to the lath.

The properties of the resilient material are important, and in comparison with timber or metal is relatively soft, offering almost no resistance to nail penetration. It must however have sufficient compressive resistance and resilience to spread forces or compressive loadings evenly over the irregular surface of the masonry wall that occur during its installation and serviceable lifetime.

In this sense it performs in an absorbing and elastomeric fashion, locally deforming to the irregular masonry surface when loadings or forces are applied and returning generally to its original shape. This action is most pronounced during the nailing operation described above, the force of the hammer blow needed for the nail to penetrate the harder and denser layer causes the material to deform to the irregular contours of the masonry wall surface and in doing so absorbs and spreads the shock, transferring the balance of it onto the masonry wall which has the necessary mass to absorb easily.

An important feature of this resilient material is that it absorbs, deforms and evenly spreads the shock forces and that it does not rebound quickly or violently and break the bonding to the masonry wall, however its resilience will allow it to slowly recover mostly to its original shape.

The harder and denser layer requires suitable properties for a nail to be driven into or through it and hold the nail firmly, alternatively if a screw is used it must also hold that firmly. Being a much denser material it will transfer most of the shock to the softer resilient layer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
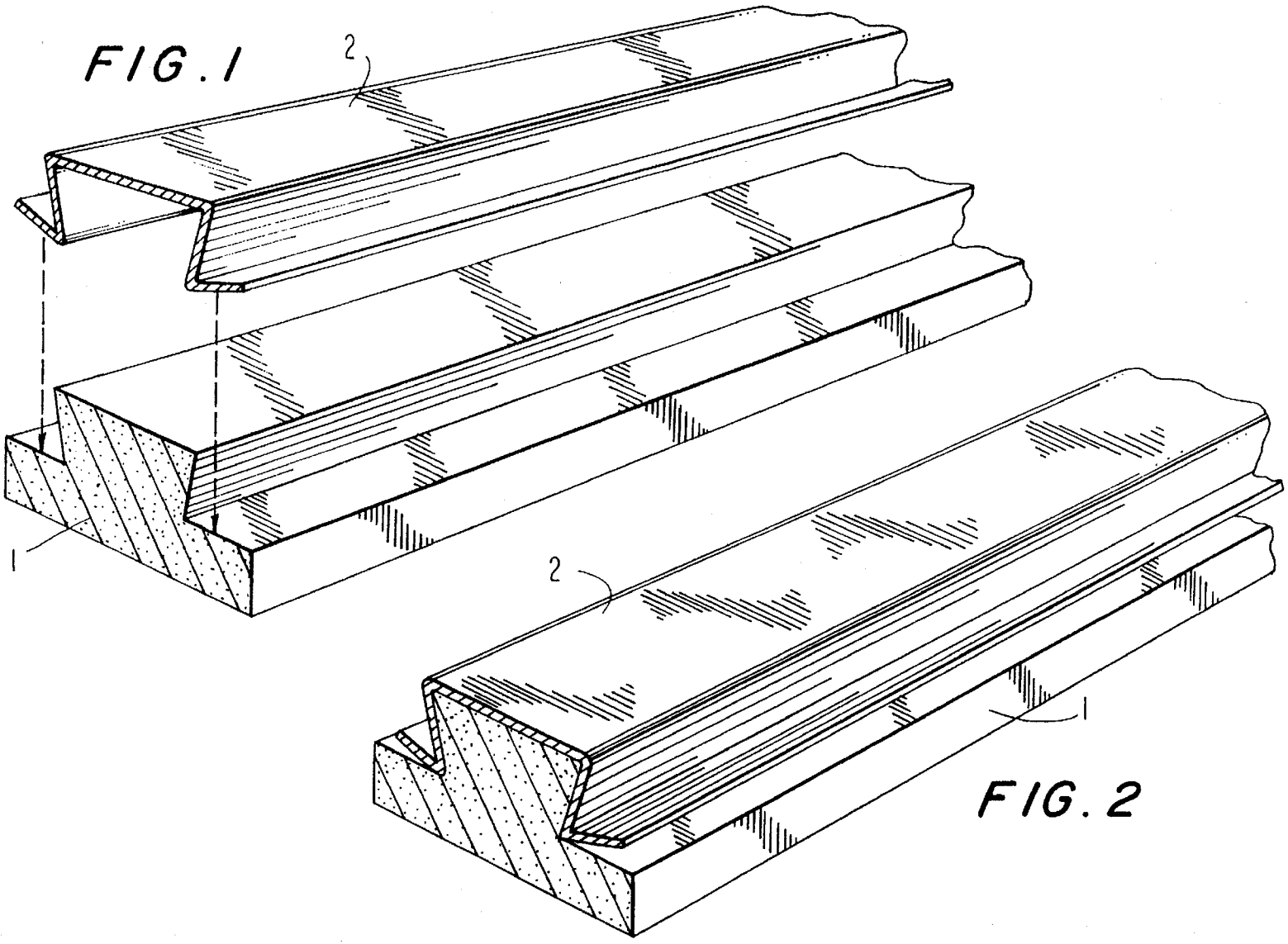
FIG. 1 is an exploded view showing the two components of a lath according to the invention, separated.
FIG. 2 is also an isometric view showing the two elements secured together.

FIG. 1 shows an elongated element composed of compressibly resilient material 1 and an elongated portion composed of metal 2. The metal element 2 is attached to the compressive material 1 by its dovetailed shape enabling it to fit snugly over the dovetail shape of the compressive material which prevents the two from direct horizontal separation. An adhesive may be used to bond the materials together if considered necessary.

In FIG. 2 the two elements 1 and 2 are shown secured together to form a lath according to the invention.

Figure 3:
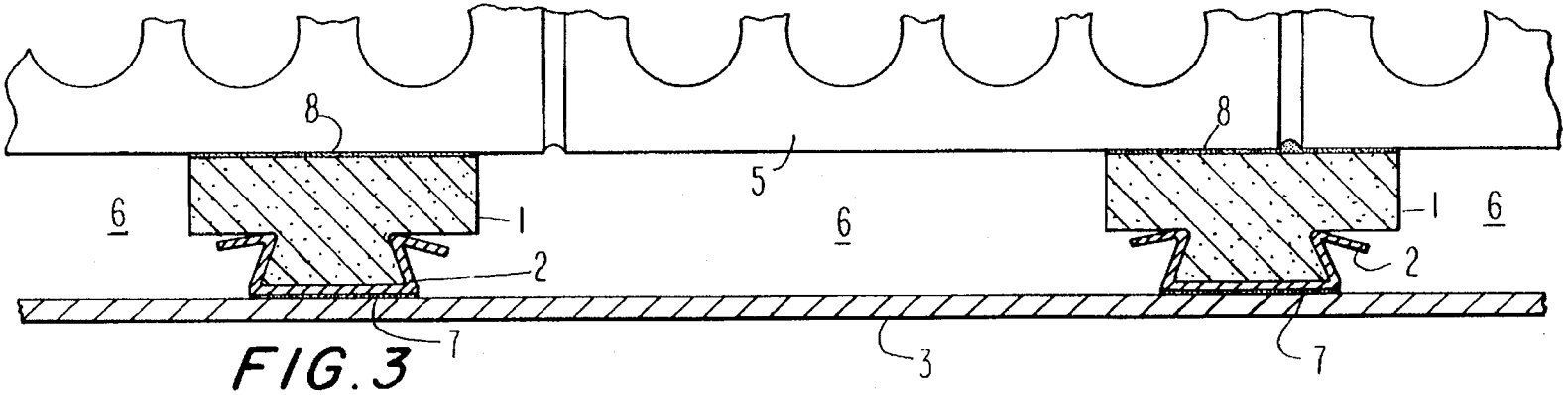
FIG. 3 is a sectional plan view of a section of walling showing plasterboard secured to a masonry wall by lathes according to the invention.

FIG. 3 is a plan view of two lathes each made up of a compressively resilient element 1 and a metal element 2, in position, bonded by adhesive 8 to a masonry wall 5, creating a cavity 6. The plasterboard or lining material 3 is bonded to the metal portions 2 of the lathes by an adhesive layer 7.

Figure 4:
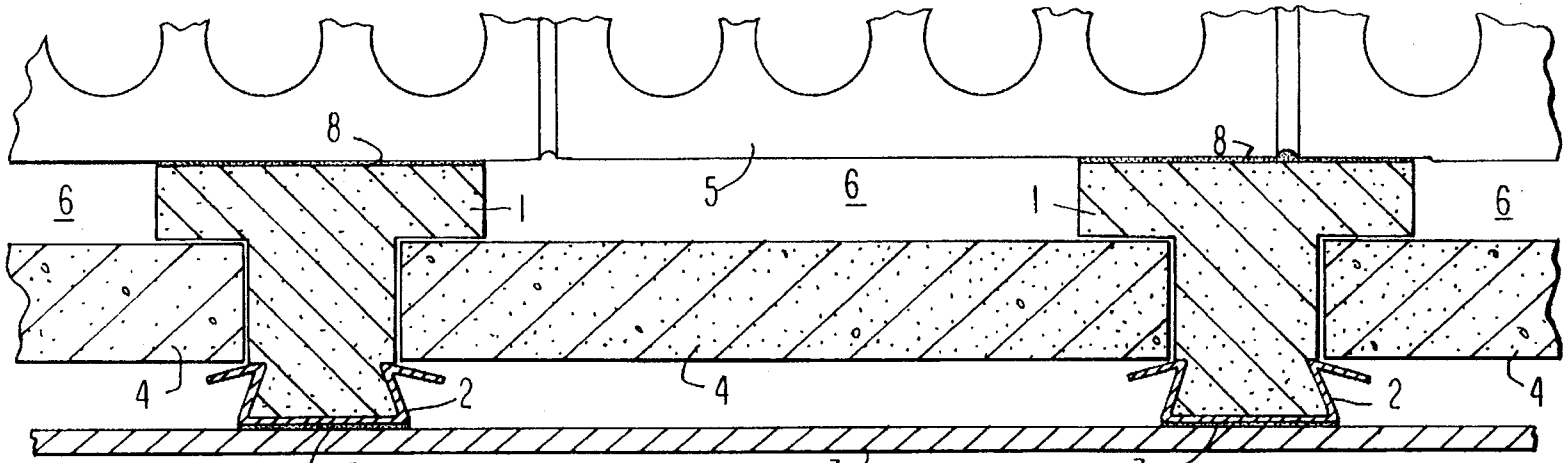
FIG. 4 is a view similar to FIG. 3 showing an alternative form of construction.

FIG. 4 is a view similar to that of FIG. 3 showing the use of an enlarged element 1 of the lath which provides an air space 6 and permits the installation of insulation 4.

Figure 5:
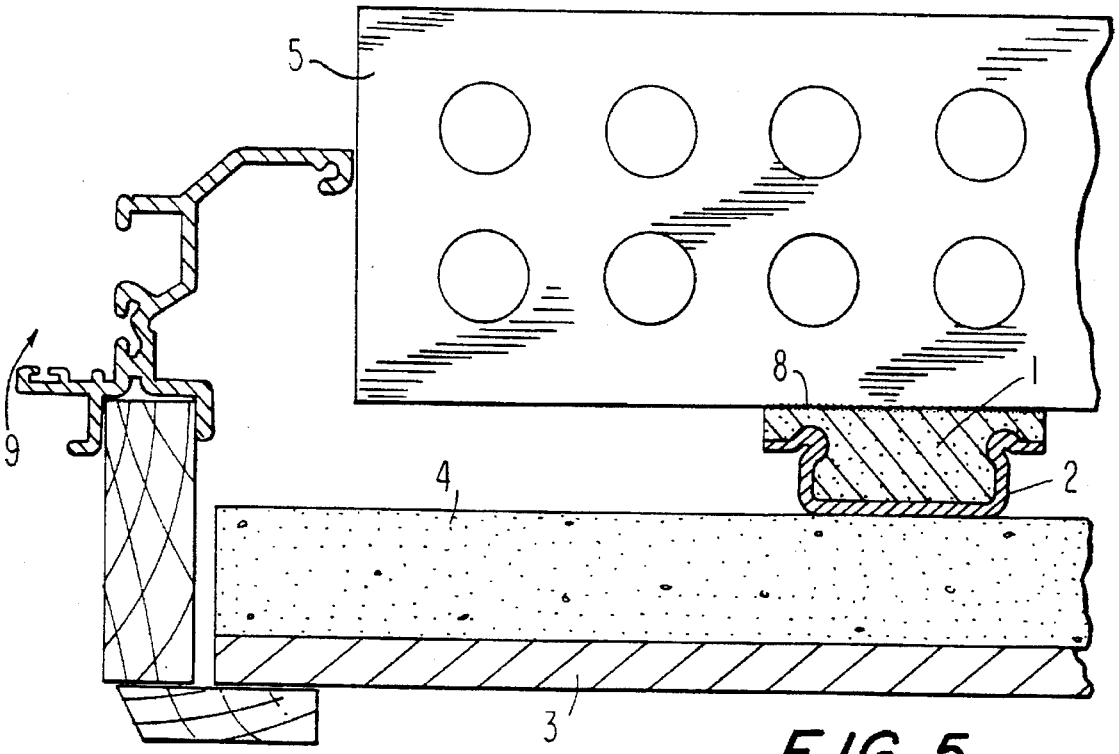
FIG. 5 is a similar view showing a lath according to the invention arranged adjacent a window opening.

FIG. 5 is again a view in plan similar to FIG. 3 but showing a lath of somewhat different cross-sectional shape secured to a masonry wall by an adhesive 8. A layer of insulating material is interposed between the fibrous plaster sheets 3 and the metal element 2 of the lath. A window opening is indicated at 9.

Figure 6:
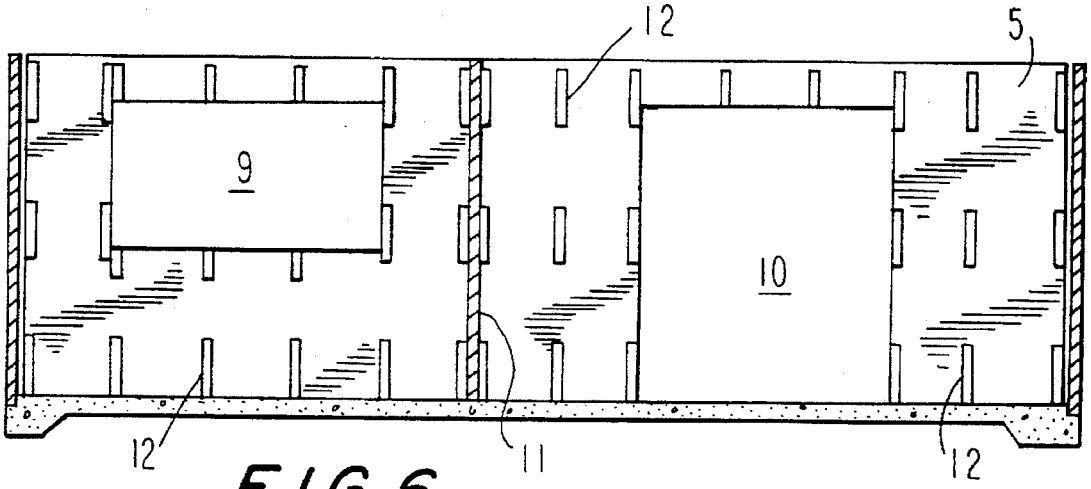
FIG. 6 is an elevation of a section of a wall showing lengths of lath bonded to masonry.

FIG. 6 shows an elevation of a section of a wall incorporating a window 9 and a door opening 10. Lengths of lath 12 are shown bonded to a masonry wall 5 ready to receive a covering layer of fibrous plaster. A stud wall intersection is indicated at 11.

A suitable softer resilient material would be semi rigid polystyrene foam, dense enough to absorb and transfer shock but flexible enough to follow the general contours of the masonry wall surface. Many other types of foam materials would also be suitable provided their properties were able to perform the same function. The density for this resilient layer would range from slightly less than 10 kgs/m$^3$ to 70 kgs/m$^3$. Polystyrene foam would also be suitable for some applications.

The density and the type of the foam would vary depending on the degree of irregularities on the masonry surface. It is also preferred that the foam material not transmit moisture from the wall to the hard skin and if it is absorbent, as many are, that it be not prone to rot.

A commercially available materials suitable for use for the purposes of the invention is manufactured and sold under the registered trademark "ISOLITE" by Rmax, a division of Olympic General Products Pty Ltd. This is a block molded flame retardant modified grade of EPS (expanded polystyrene). This material is sold in various classes of which class L and SL are the most suitable for purposes of the present invention. Full details of the physical and mechanical properties of this material are available from the manufacturers.

A suitable very dense hard thin skin layer would be metal of approximately 0.4 mm–2 mm thick ranging between 2650 kgs/m$^3$ to 7,800 kgs/m$^3$, the material must be hard, dense and resilient enough to hold onto a driven nail or screw after penetration. The nail can have small serrations on its shank to assist performance if required. The hard layer's sectional design can vary considerably and must enable it to flex readily so that it too can conform to the overall full height contour, if that is required, of the masonry wall.

Another suitable dense but thicker material would be timber of 10 mm to 50 mm thick with a density of 300 kgs/m$^3$ to 1,000 kgs/m$^3$ which also would have to hold onto a driven nail or screw. In larger thicknesses and higher densities difficulty will be experienced with straightness and stability of the timber.

The softer resilient material can be altered in section size and shape to allow a cavity of varying width to be formed between the plasterboard and the masonry wall, either to be used as an air space or to position insulation (FIG. 4), vapor barriers or moisture barriers.

Although the two components work exceptionally well together the softer resilient material need not necessarily be continuous. This however depends on the sectional stiffness of the hard dense layer and the nailing spacings require to fix or hold the plasterboard sheet.

In a preferred application the lath is not continuous and is just a series of short pieces spaced apart to suit the spanning ability of the lining material as is shown in FIG. 6. The lath can also be used to be fixed horizontally for other fixing applications or to assist in attaching service conduits.

The softer resilient material can be bonded to the masonry wall with a variety of adhesives, if the masonry wall has an exposed external surface both the softer resilient material and the adhesive must not be able to be damaged by moisture. If a moisture barrier is required there are several types of adhesives that also act as a moisture barrier to prevent any absorption of moisture, this is one of several solutions to this potential problem.

Figure 7:
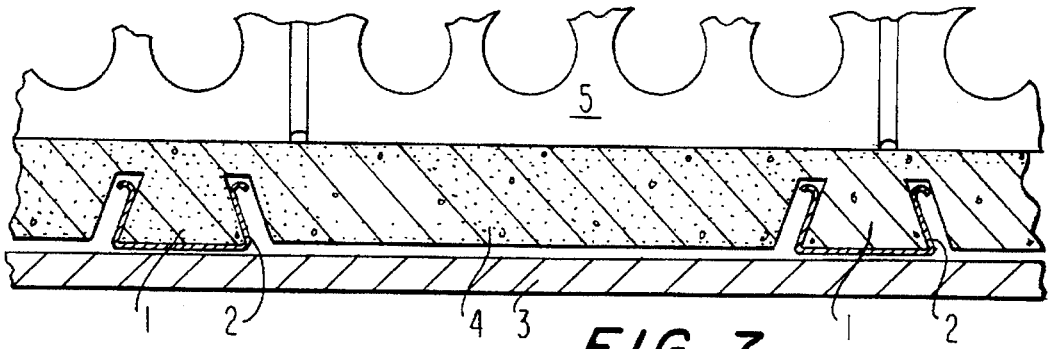
FIG. 7 is a plan view similar to FIG. 3 showing an alternative form of construction.
Figure 8:
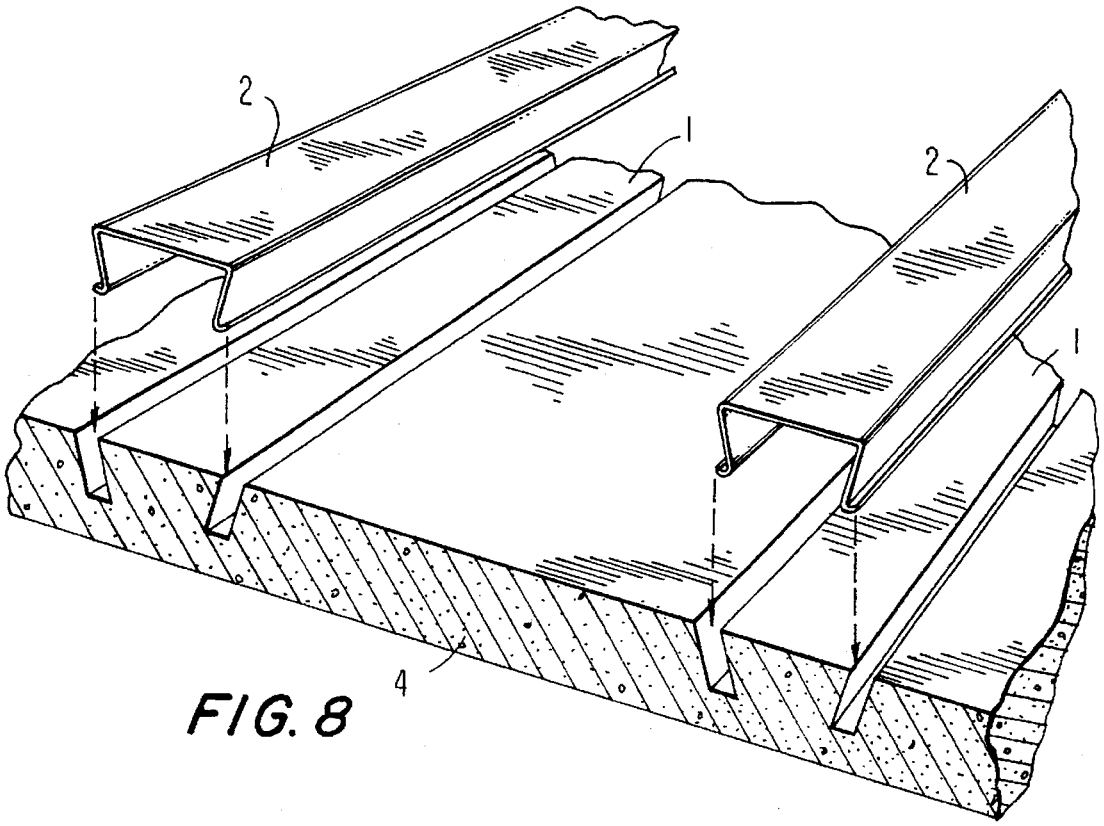
FIG. 8 is an isometric view of the form of construction shown in FIG. 7.

Another example of the application of this invention is shown in FIG. 7 and FIG. 8 in which the external wall 5 requires the lining 3 to be insulated with a similar polystyrene or polyurethane material 4 as is being used as the resilient material in the laminated lath. In this case the softer resilient material and the wall insulation material are made of the same material and therefore can be made in one piece and incorporated in sheet form.

FIG. 7 is a plan view similar to FIG. 3 but instead showing the lath system where the soft resilient material 1 is incorporated into the insulation material 4 in a sheet form. The sheet insulation material 4 is bonded to the masonry wall 5 or mechanically fixed through the hard dense skin 2 into the masonry wall 5. The performance of this type of lath system would be similar to all other types described herein and similarly the hard dense skin 2 need not be continuous and could be installed vertically or horizontally.

The laminated lath in this form of contribution, has become an integral part of the insulation sheet material, this can only occur when the properties of the insulation material and the softer resilient material are identical.

FIG. 8 is an isometric view showing how the insulation sheet material 4 can be slotted or grooved to allow the hard dense material 2 to mechanically lock onto it.

This is achieved by forming or cutting twin parallel angled slots into one face of the sheet insulation material to form the dovetail outline so as to allow the dense hard material 2 to fit into and lock onto the dovetail section so formed on the face of the sheet insulation material.

Figure 9:
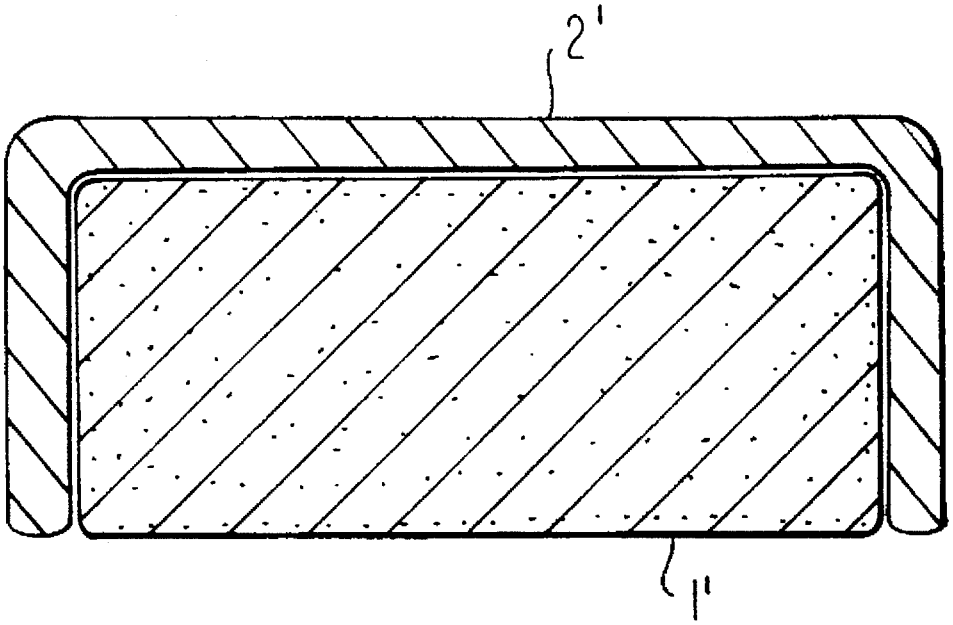
FIG. 9 is a view showing a section of a further embodiment of the invention.

FIG. 9 shows a further embodiment of a support which has an elongated element composed of compressibly resilient material 1' and an elongated element composed of metal 2'. The element 1' has a polygonal cross-section with four sides, while the element 2' surrounds the element 1' at three sides thereof. The elements 1' and 2' have interlocking (interengaging) shapes.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A composite laminated lath for fixing plasterboards, comprising a first elongated element having four sides and composed of a compressive lightweight resilient material selected from the group consisting of a rigid material and a semi-rigid material and a second elongated element overlaying said first elongated element and composed of a material which is denser than a material of said first elongated element and which is penetrable by at least one fixing element selected from the group consisting of screws and nails and also is hard, dense and resilient enough to hold onto the fixing element after penetration, said first and second elongated elements having interlocking shapes so that in an assembled condition these elements are held together because of said interlocking shapes, and said second elongated element bracing said first elongated element on three of said sides of said first element.

2. A composite laminated lath for fixing plasterboards, comprising a first elongated element having four sides and composed of a compressive lightweight resilient material selected from the group consisting of a rigid material and a semi-rigid material and a second elongated channel-shaped element overlaying said first elongated element and composed of a material which is denser than a material of said first elongated element and which is penetrable by at least one fixing element selected from the group consisting of screws and nails and also is hard, dense and resilient enough to hold onto the fixing element after penetrating, said first and second elongated elements having interlocking shapes so that in an assembled condition these elements are held together because of said interlocking shapes, and said second elongated element bracing said first elongated element on three said sides of said first element.

3. A composite laminated lath for fixing plasterboard sheets, comprising a first elongated element consisting of a compressive lightweight resilient material selected from the group consisting of a rigid material and a semi-rigid material, and a second elongated element overlaying said first elongated element and composed of a material which is denser than a material of said first elongated element and which is penetrable by at least one fixing element selected from the group consisting of screws and nails and also is hard, dense and resilient enough to hold onto the fixing element after penetration, said first and second elongated elements having mechanically interlocking shapes so that in an assembled condition these elements are held together because of said interlocking shapes, said first element having a first dovetail formation while said second element has a second dovetail formation engaging with said first dovetail formation, said formations having said interlocking shapes.

4. A composite laminated lath for fixing plasterboard sheets, comprising a first elongated element consisting of a compressive lightweight resilient material selected from the group consisting of a rigid material and a semi-rigid material, and a second elongated element overlaying said first elongated element and composed of a material which is denser than a material of said first elongated element and which is penetrable by at least one fixing element selected from the group consisting of screws and nails and also is hard, dense and resilient enough to hold onto the fixing element after penetration, said first and second elongated elements having mechanically interlocking shapes so that in an assembled condition these elements are held together because of said interlocking shapes, said first element having a dovetail section while said second element is formed as a sheet provided with a dovetail portion engaging in said dovetail section of said first element, said dovetail portion and section having said interlocking shapes.

5. A plaster board assembly comprising a plasterboard sheet; and a plurality of spacing elements connecting said plasterboard sheet with a framework and spaced from one another in a transverse direction, each of said spacing elements including a first elongated element consisting of a compressive lightweight resilient material selected from the group consisting of a rigid material and a semi-rigid material, and a second elongated element overlaying said first elongated element and composed of a material which is denser than a material of said first elongated element and which is penetrable by at least one fixing element selected from the group consisting of screws and nails and also is hard, dense and resilient enough to hold onto the fixing element after penetration, said first and second elongated elements having mechanically interlocking shapes so that in an assembled condition these elements are held together because of said interlocking shapes.

* * * * *